US006135435A

United States Patent [19]

Schmitz

[11] Patent Number: 6,135,435

[45] **Date of Patent: *Oct. 24, 2000**

[54] WOODWORKER'S VISE

[75] Inventor: Ambrose Schmitz, Lake Barrington, Ill.

[73] Assignee: Wilton Corporation, Palatime, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/693,452

[22] Filed: Aug. 7, 1996

[51] Int. Cl.[7] ..... B25B 1/02

[52] U.S. Cl. ..... 269/164; 269/185; 269/258; 269/261

[58] Field of Search ..... 269/164, 173–188, 269/261, 258

[56] References Cited

U.S. PATENT DOCUMENTS

| | | | |
|---|---|---|---|
| 449,987 | 4/1891 | Wies | 269/261 |
| 457,710 | 8/1891 | Emmert | 269/261 |
| 1,106,096 | 8/1914 | Hunt | 269/182 |
| 1,497,107 | 6/1924 | Lasell | 269/164 |
| 3,193,277 | 7/1965 | Nagamori | 269/181 |
| 4,830,350 | 5/1989 | Kuei . | |

FOREIGN PATENT DOCUMENTS

| | | | |
|---|---|---|---|
| 332373 | 3/1920 | Germany . | |
| 1099478 | 2/1961 | Germany . | |
| 8907067 | 6/1989 | Germany . | |
| 819506 | 9/1959 | United Kingdom . | |
| 956390 | 4/1964 | United Kingdom | 269/185 |
| 973387 | 10/1964 | United Kingdom . | |
| 2063111 | 6/1981 | United Kingdom | 269/258 |
| 2182271 | 5/1987 | United Kingdom . | |
| 2221634 | 2/1990 | United Kingdom . | |

*Primary Examiner*—Robert C. Watson

[57] ABSTRACT

A woodworker's vise that includes a fixed jaw adapted to be mounted to a workbench or the like and a moveable jaw assembly adapted to move with respect to the fixed jaw. The moveable jaw assembly includes an inner jaw, a front support and preferably a pin mounting the inner jaw to the front support in a manner that permits the inner jaw to pivot and to slide vertically relative to the front support. The woodworker's vise also includes a rapid-acting nut assembly disposed about the spindle that includes a pair of cam surfaces for causing engagement and disengagement of the assembly and the spindle.

23 Claims, 5 Drawing Sheets

WOODWORKER'S VISE

BACKGROUND

Woodworker's vises used to hold pieces of wood or the like in place are well known in the art. Typically, the vises are mounted to a workbench and include a fixed jaw and a moveable outer jaw that define a pair of parallel faces or surfaces for holding the work piece. Because of their construction, these prior art vises are adapted to hold work pieces having opposing parallel sides, but generally are not well suited to be used with work pieces not having opposing parallel sides.

Additionally, during woodworking, the work pieces often are larger than can be conveniently clamped within the vise. To hold such work pieces in place, it is known to use adjustable front stops or dogs in the moveable outer jaw that are usually in the form of rectangular metal pieces slidably mounted in a vertical opening in the jaw with means for moving the dog into an upper operating position or retracted to a lower non-operating position. When a large flat work piece needs to be held, it is placed on the workbench and the dog is moved to the upper position to engage the outer edge of the work piece. The opposite edge of the work piece is held in place by being pushed against another bench dog or stop, which is a separate piece of metal or other material mounted in a vertical hole pre-drilled in the woodworker's bench.

Typically, the movement of the moveable jaw is accomplished by a relatively long screw or spindle rotatably mounted on the moveable jaw that engages a female-threaded nut or other device mounted on the fixed jaw. By turning a handle located outward of the moveable jaw, the moveable jaw can be moved back and forth relative to the fixed jaw.

Guide bars, extending parallel to the spindle, are usually included to guide the movement of the moveable jaw and also to prevent rotation of one jaw with respect to the other. When the work piece is engaged and the spindle is rotated, the guide bars maintain the jaws parallel to each other to enable hold the work piece.

One known way to avoid extensive and time consuming rotation of screws in vises is to include a rapid-acting nut. By rotating the handle, the rapid-acting nut can disengage the threaded nut from the threaded spindle, permitting the moveable jaw to freely move toward the fixed jaw. By reversing the rotation of the handle, the rapid-acting nut engages the spindle threads, permitting closing of the vise jaws and clamping action by continued motion.

Because of the construction of these rapid-acting nuts, however, dust, dirt or other debris tends to accumulate on the spindle threads, which tends to disable the rapid-acting nut. Removal of this debris can be tedious and time consuming and usually requires disassembly of the vise.

Accordingly, it is an object of the present invention to provide a woodworker's vise that is better adapted to be used with work pieces of different configurations.

It is a further object of the present invention to provide such a device that includes a moveable jaw that is adapted to pivot and move vertically to accommodate the work piece.

It is a still further object of the present invention to provide a rapid-acting nut assembly for a vise that reduces or eliminates the likelihood of debris accumulating on the threads of the spindle.

It is a still further object of the present invention to provide such a rapid-acting nut assembly that operates by camming action.

SUMMARY

In accordance with a preferred embodiment of the invention, a woodworker's vise is provided that includes a fixed jaw adapted to be mounted to a workbench or the like, a moveable jaw assembly adapted to move with respect to the fixed jaw, and a spindle. The moveable jaw assembly includes an inner jaw, a front support and preferably a pin mounting the inner jaw to the front support in a manner that permits the inner jaw to pivot and to slide or move to an elevated position relative to the front support.

The pivoting movement of the inner jaw enables the vise to accommodate irregular-shaped boards or other work pieces (such as, for example, tapered table legs or the like). Additionally, the upward movement of the inner jaw is intended to perform the function of the moveable dog in conventional woodworker's vises. For example, when the inner jaw is in its upward position, it can be used with bench dogs located on the workbench to hold the work piece. The inner jaw in accordance with the present invention, however, provides a relatively large area for contacting the work piece when the bench dogs are being used.

In a preferred embodiment, the vise also includes an inverted U-shaped guide that defines a channel and a spindle received substantially within the channel. The U-shaped guide preferably is rigidly mounted to the moveable jaw assembly and is adapted to slide relative to the fixed jaw.

The vise also preferably includes a rapid-acting nut assembly disposed about the spindle and received within the channel. The rapid-acting nut assembly includes a nut that receives the spindle, a pair of outer cam surfaces engageable with the inside of the U-shaped guide, a biasing member adapted to urge the spindle into engagement or disengagement with the nut in response to rotation of the spindle and engagement of the respective outer cam surfaces with the inside of the U-shaped guide. The nut is intended to threadingly engage the spindle when the first cam surface is engaged with the inside of the guide and to become disengaged from the spindle when the second cam surface is engaged with the inside of the U-shaped guide. The nut desirably includes a plurality of crescent-shaped internal threads along the length of the nut that are engageable with the threads of the spindle.

The present invention and the advantages thereof will become more apparent upon consideration of the following detailed description when taken in conjunction with the accompanying drawings.

DETAILED DESCRIPTION OF THE PREFERRED EMBODIMENTS

Figure 1:
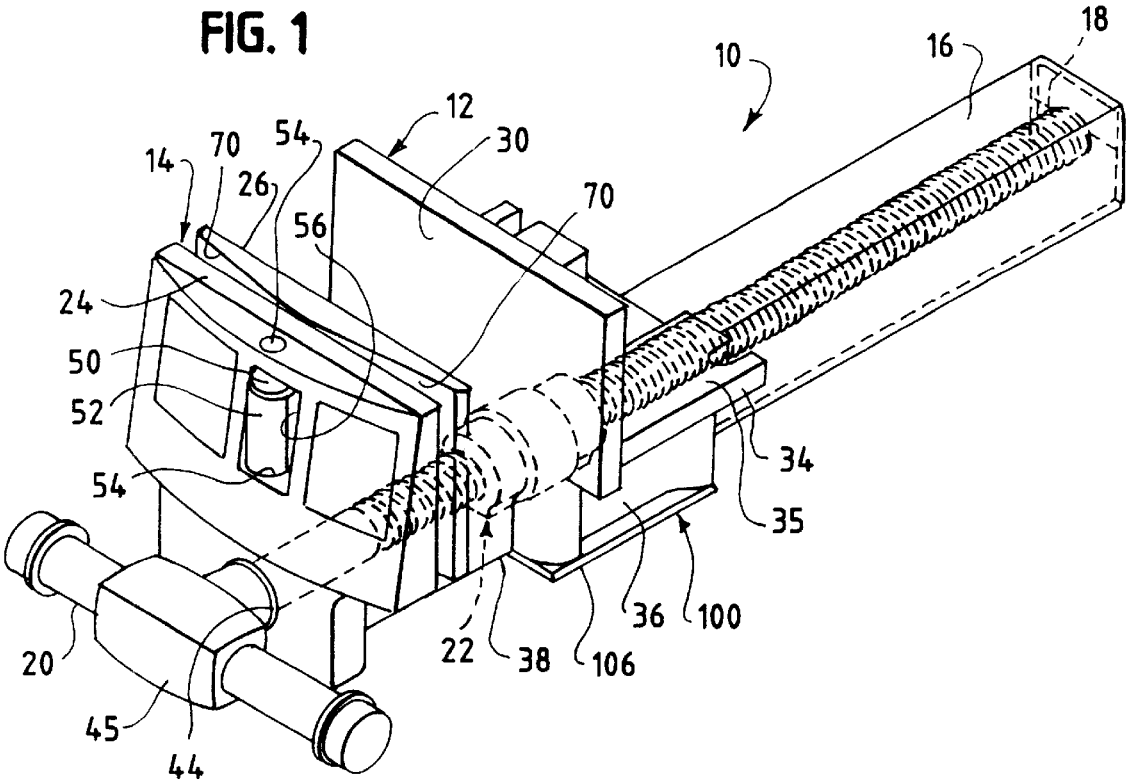
FIG. 1 is a perspective of a woodworker's vise in accordance with an embodiment of the invention.
Figure 2:
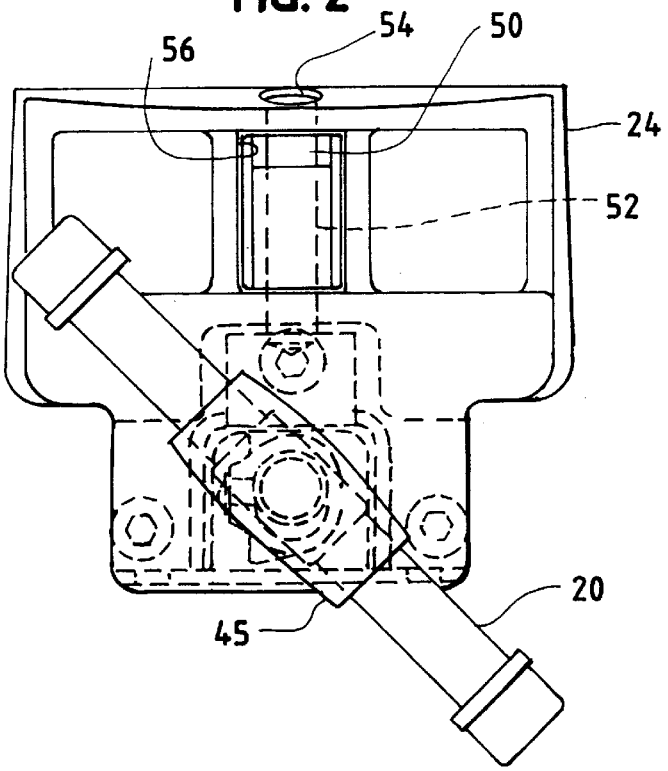
FIG. 2 is a front elevational view of the vise of FIG. 1.
Figure 3:
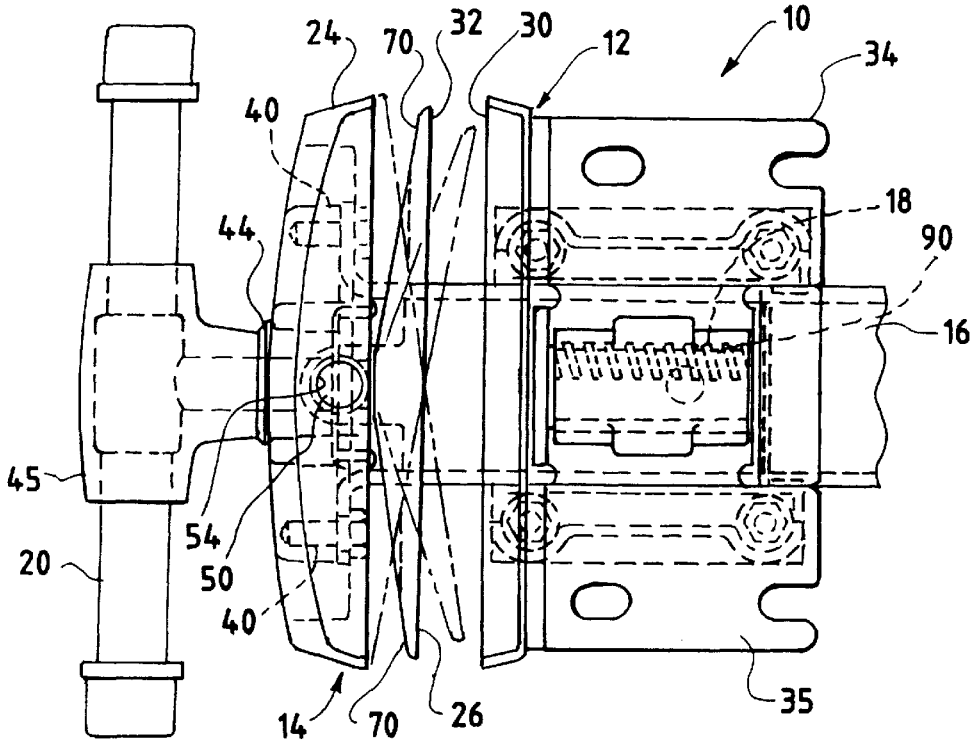
FIG. 3 is a top broken view of the woodworker's vise of FIG. 1.
Figure 4:
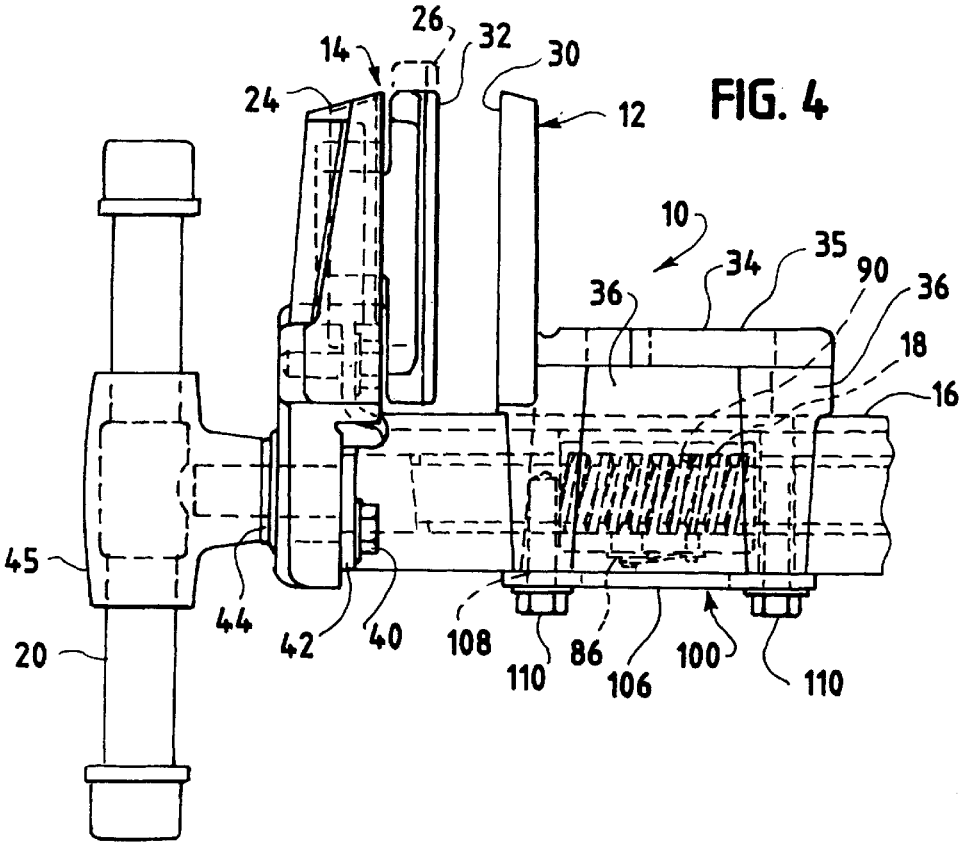
FIG. 4 is a side broken view of the woodworker's vise of FIG. 1.
Figure 6:
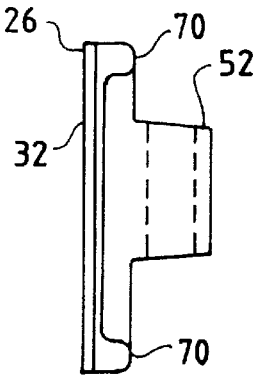
FIG. 6 is a side elevational view of the inner jaw of FIG. 5.
Figure 5:
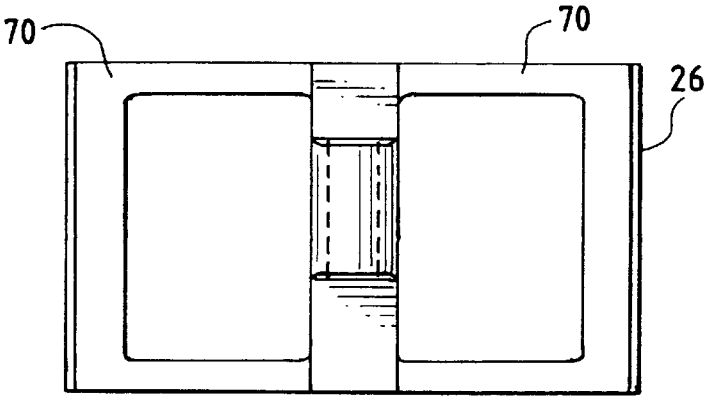
FIG. 5 is a front elevational view of the inner jaw of the woodworker's vise of FIG. 1.
Figure 7:
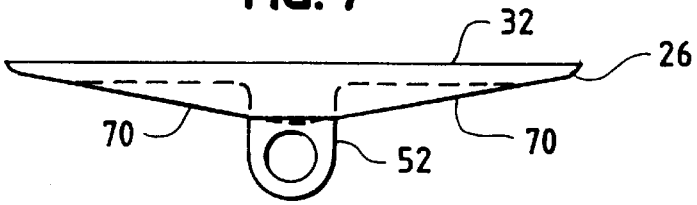
FIG. 7 is a top view of the inner jaw of FIGS. 5 and 6.

A woodworker's vise 10 in accordance with a preferred embodiment of the invention comprises generally a fixed jaw 12, a moveable Jaw assembly 14, a guide rail 16, a threaded spindle 18, a handle 20 rigidly mounted to a distal end of the spindle, and a rapid-acting nut assembly 22 disposed about the spindle. The moveable jaw assembly 14 in accordance with a preferred embodiment includes a front support 24 and an inner jaw 26.

The fixed jaw 12 and inner jaw 26 each includes a contact surface 30, 32 for contacting the surface of a work piece so that the work piece can be held between the fixed and inner jaws. The fixed jaw 12 may be mounted to a workbench in any suitable manner. In the illustrated embodiment, for example, the fixed jaw 12 includes a base 34 that can be secured to the workbench by fasteners or in any other suitable manner. The illustrated base 34 includes a mounting plate 35 for receiving the fasteners and a pair of wall supports 36. The mounting plate 35 and wall supports 36 define a channel 38 for slidably engaging the outside of the guide rail 16.

The moveable jaw assembly 14, guide rail 16, spindle 18, and handle 20 are preferably joined together in a manner that permits movement of the moveable jaw assembly, guide rail, spindle and handle relative to the fixed jaw and that permits rotation of the handle and spindle relative to the moveable jaw assembly.

In the illustrated embodiment, for example, the front support 24 is rigidly mounted to the guide rail 16 by a pair of fasteners 40 extending through a flange 42 included on the guide rail 16. The front support 24 may define an aperture 44 that receives a distal portion of the spindle 18 so that the distal end of the spindle extends beyond the front support 24. The handle 20 is positioned on a distal side of the front support 24 and adapted to rotate relative to the front support 24. The distal portion of the spindle 18 preferably has a reduced diameter that complements the diameter of the aperture 44. The distal end of the spindle 18 preferably is rigidly secured to a collar 45 included on the handle 20 that is mounted to the front support 24 in a manner that permits rotation of the handle 20 relative to the front support.

The inner jaw 26 preferably is adapted to pivot and to move or slide relative to the front support 24 in a direction that preferably is generally perpendicular to the axis of the spindle 18. In a preferred embodiment, the inner jaw and front support are mounted together by a spring-loaded pin 50. The spring-loaded pin 50 extends through a channel defined on a cylindrical projection 52 included on a distal side of the inner jaw 26, and is mounted to the front support 24 in any suitable manner. In the illustrated embodiment, the spring-loaded pin 50 is mounted to the front support 24 within a pair of apertures 54 defined by the front support. Preferably, the apertures 54 are disposed about a bore 56 defined by the front support 24 that receives the cylindrical projection 52.

Figure 8:
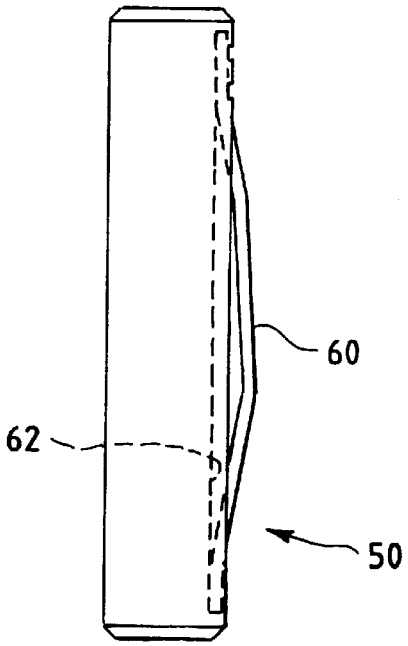
FIG. 8 is an elevational view of the spring-loaded pin adapted to mount the inner jaw of the moveable jaw assembly to the front support of the moveable jaw assembly.

As illustrated in FIG. 8, the spring-loaded pin 50 includes a spring 60 that preferably is bent and elongated and adapted to be received within a slot 62 defined on the spring 60. In the illustrated embodiment, the pin 50 is peened adjacent one end of the pin to retain a portion of the spring 60 within the slot 62.

The inner jaw 26 also preferably includes a pair of tapered surfaces 70 on its distal side to facilitate pivoting acting of the inner jaw 26 relative to the front support 24 in the lateral direction. In the illustrated embodiment, for example, each of the tapered surfaces form a square or rectangle. The angle of the tapers preferably are each about 100 relative to a proximal side of the front support 24.

The moveable jaw assembly 14 in accordance with a preferred embodiment of the invention provides several advantages. For example, in its upward position, the inner jaw 26 can be used with bench dogs located on the workbench, and also provides a relatively large surface area to increase stability of the work piece during woodworking. Additionally, due to the pivotability of the inner jaw 26, the vise 10 also can readily accommodate irregular-shaped boards or other work pieces.

In a preferred embodiment of the invention, the guide rail 16 preferably has an inverted U-shape configuration and defines a channel substantially along the guide rail 16. The spindle 18 is received substantially within the channel substantially along the length of the spindle. The guide rail 16 preferably is rigidly mounted to the moveable jaw assembly 14 and slidably mounted to the fixed jaw 12, and includes a flat inner surface 74 adapted to function as a cam follower or cam-engaging surface as described below.

In a preferred embodiment, the rapid-acting nut assembly 22 is disposed within the guide rail 16, and includes a nut or collar 80 disposed about the spindle 18, first and second cam surfaces 82, 84 adapted to contact the flat surface 74 of the guide rail 16, and a biasing member 86 adapted to urge the spindle 18 into engagement or disengagement with the nut 80 in response to rotation of the spindle 18 and engagement of the respect cam surface 82 or 84 with the flat surface. The nut 80 preferably is cylindrical and includes a plurality of internal threads 90 along the length of the nut. The internal threads 90 may be crescent-shaped, desirably extending less than half way around the nut. In a preferred embodiment, each internal thread 90 has an arcuate length of about 180° or less.

The first and second cam surfaces 82, 84 may be mounted or joined to the nut 80 in any suitable manner. For example, they may be included as part of a sleeve or collar 81 or the like disposed about the nut, or they may be integral or unitary with the nut. The biasing member 86 may have any suitable construction. It may, for example, be in the form of a spring-loaded bolt or friction shoe or the like that extends through a hole 94 defined in the nut 80. The biasing member 86 presses the spindle in a direction perpendicular to the axis of the nut.

In a preferred embodiment, the rapid-acting nut assembly 22 is secured axially to the spindle 18 by a plate 100 mounted to the fixed jaw 12. The plate 100 includes a pair of spaced retaining walls 102, each of which defines an aperture 104 for receiving the spindle 18. Each of the spaced retaining walls 102 abuts or is adjacent to a respective end of the nut 80 to prevent or restrict axial movement of the rapid-acting nut assembly 22.

In the illustrated embodiment, the plate includes a pair of rectangular mounting ears 106, each of which defines a pair of holes 108. The plate 100 is secured to the fixed jaw 12 by fasteners 110 that extend through the holes 108 at the bottom of the bracket 36.

Figure 9:
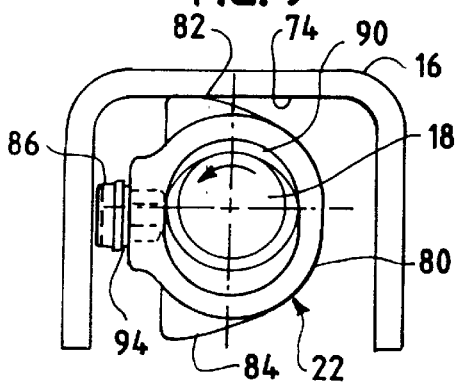
FIGS. 9–15 illustrate the operation of the rapid-acting nut in sequential steps.

With reference to FIGS. 9–15, the rapid-acting nut assembly 22 operates as follows. FIG. 9 illustrates the spindle 18 in a tightened position. In this position, the threads 90 on the nut 80 are engaged with the external threads on the spindle 18, and the first cam surface 82 is engaged with the flat surface 74 of the guide rail 16. In this position, the moveable vise jaw assembly 14 is also in a clamped position.

To loosen the moveable jaw assembly 14, the spindle 18 should be rotated in a first direction (e.g., counter-clockwise in the illustrated embodiment) by turning the handle 20. The rotation of the spindle 18 causes the nut 80 to rotate initially with the spindle 18 because of the force exerted on the spindle by the biasing member 86 and also causes the first cam surface 82 to disengage from the flat surface 74 of the guide rail 16.

Figure 10:
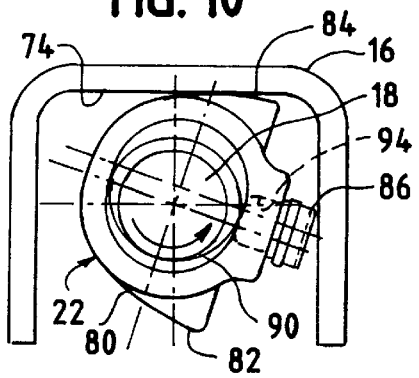

After the spindle 18 has been rotated about 160°, the second cam engaging surface 84 begins engaging the flat surface 74 of the guide rail 16 (see FIG. 10). As the spindle 18 rotates, the wedging action of the second cam surface 84 against the flat surface 74 causes the nut 80 to stop rotating and forces the nut downward, aided by gravity.

Figure 11:
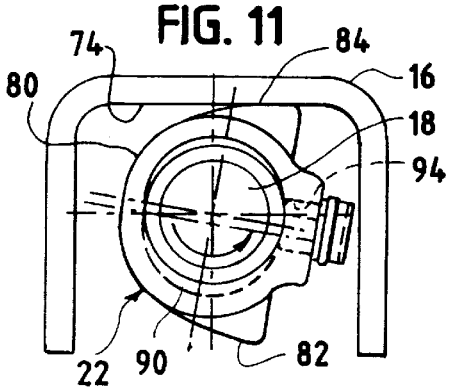

FIG. 11 shows the partial disengagement of the spindle 18 from the nut 80 as the spindle continues to rotate another approximately 10° with the nut moving down, preferably about ½ the depth of the thread (e.g. about 1/16 of an inch in a typical installation).

Figure 12:
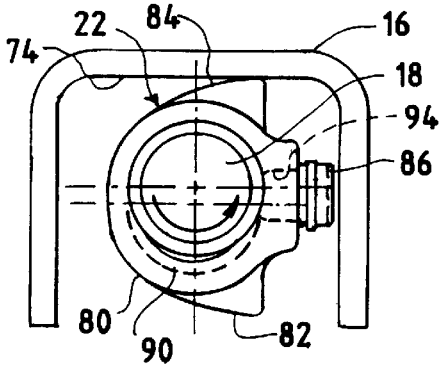

FIG. 12 shows the configuration after an additional counter-clockwise turning of about 10°. At that point, the nut 80 can no longer rotate because the second cam surface 84 is now wedged. The wedging force at this point is strong enough to overcome the force imposed by the biasing member 86, causing the spindle 18 to disengage threadingly from the nut 80 and thereby enabling the spindle 18 to slide axially relative to the nut. As a result, the spindle 18 and moveable jaw assembly 14 are able to move freely in or out. In the position of FIG. 12, the spindle 18 is in rapid-adjust position, the threads are disengaged, and the moveable jaw assembly 14 now can slide freely relative to the fixed jaw 12.

Figure 13:
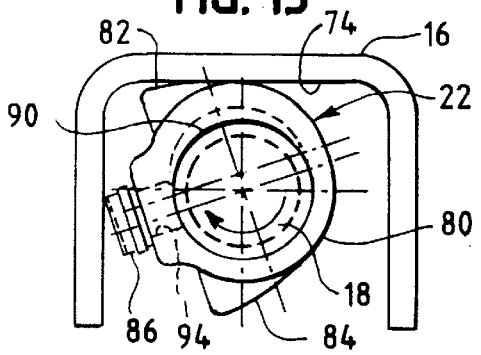
Figure 14:
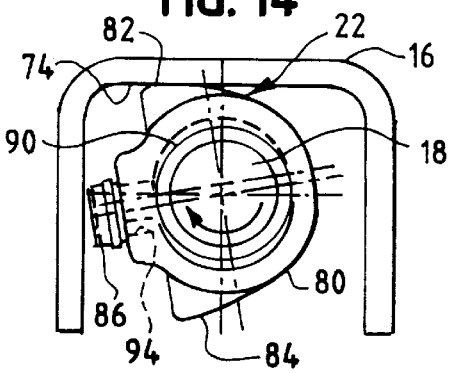
Figure 15:
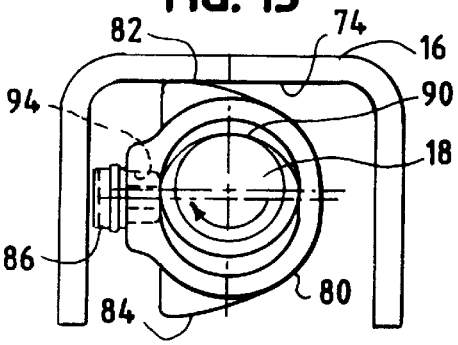
Figure 16:
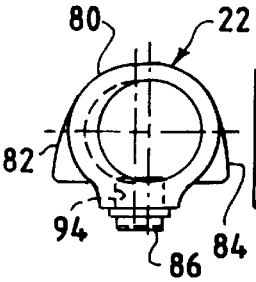
FIG. 16 is a front view of the rapid acting-nut assembly of the vise of FIG. 1.
Figure 17:
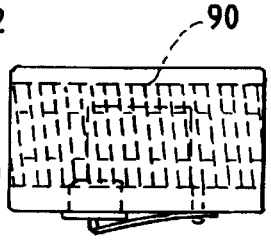
FIG. 17 is a side elevation view of the rapid acting nut assembly of FIG. 16.
Figure 18:
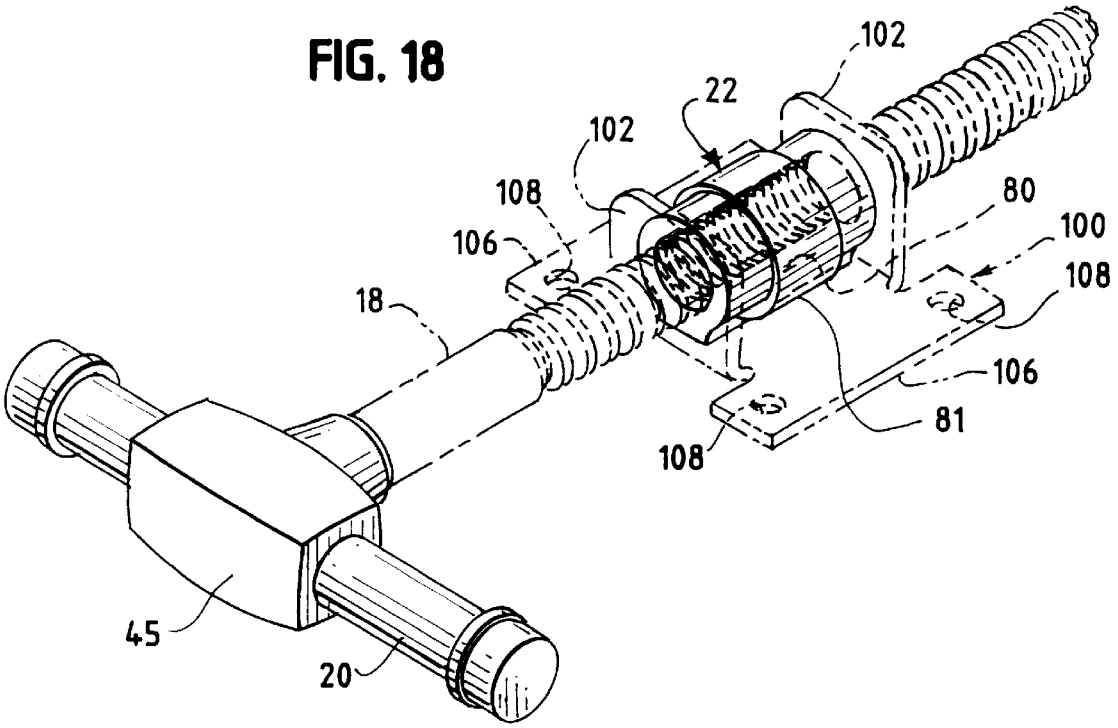
FIG. 18 is a perspective view of the spindle, handle and rapid-acting nut assembly of the vise of FIG. 1, illustrating in broken lines the plate for axially securing the rapid-acting nut assembly to the spindle.
Figure 19:
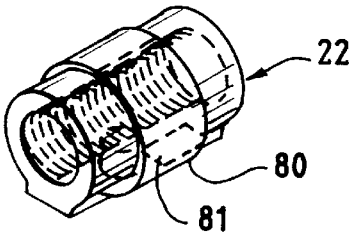
FIG. 19 is a perspective view of the rapid-acting nut assembly of FIG. 18.
Figure 20:
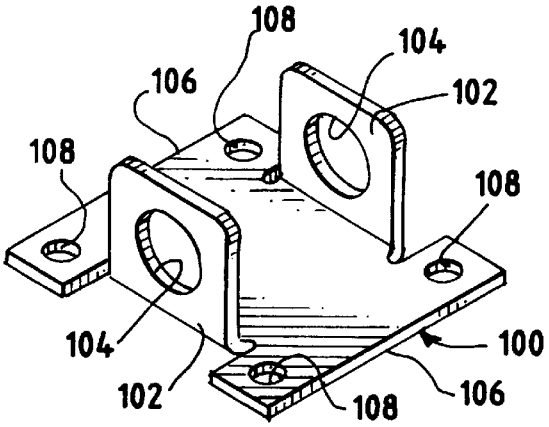
FIG. 20 is a perspective view of the plate of FIG. 18.

The handle 20 and spindle 18 can be rotated clockwise in a reverse manner to place the moveable jaw assembly back to its changed position, as illustrated sequentially in FIGS. 13–15. In FIG. 13, the first cam surface 82 begins engaging the flat surface 74 of the guide rail 16; FIG. 14 shows partial engagement of the spindle 18 and nut 80 as the spindle rotates another 10°; and FIG. 15 illustrates the spindle 18 in a tightened position.

Accordingly, the first and second cam surfaces 82, 84 provide a mechanical activating means for the rapid-action nut assembly 22 and the spindle 18 and for moving the moveable jaw assembly 14 back and forth, either in engagement where movement is by rotation of the handle 20 or, if desired, by moving the spindle 18 into the disengaged position where the moveable jaw assembly can be slid in and out without engaging the threads of the nut 80. At the same time, the inverted U-shape guide rail 16 protects the rapid-acting nut assembly 22, as well as the spindle 18, from dirt, debris, sawdust, wood chips and the like. Additionally, the moveable jaw assembly 14 includes an inner jaw 26 that can pivot and that can slide in a direction generally perpendicular to the direction in which the moveable jaw assembly 14 can move.

The foregoing description is for purposes of illustration only and is not intended to limit the scope of the protection accorded this invention. The scope of protection is to be measured by the following claims, which should be interpreted as broadly as the inventive contribution permits.

The claimed invention is:

1. A woodworker's vise comprising a first jaw, a second jaw moveable relative to the first jaw, a spindle secured to the second jaw, a single cam-engaging surface, and a rapid-acting nut assembly including a nut disposed about the spindle and first and second cam surfaces selectively engageable with the single cam-engaging surface for a shifting of the nut and cam-engaging surface relative to each other, the spindle and rapid-acting nut assembly being operatively associated in a manner such that the spindle and nut are threadedly engaged when the first cam surface is engaged with the cam-engaging surface and are threadedly disengaged when the second cam surface is engaged with the cam-engaging surface to permit the spindle to slide relative to the nut, the rapid-acting nut assembly further including a biasing spring element adapted to resiliently urge the spindle into threading engagement with the nut when the first cam surface is engaged with the cam-engaging surface, the biasing element being further adapted to resiliently urge the spindle away from the engagement with the nut when the second cam surface is engaged with the cam-engaging surface.

2. The vise of claim 1 wherein the nut includes a plurality of internal threads along at least most of the length of the nut for engaging the spindle, the internal threads having an arcuate length in the range of about 150° to 180°.

3. A woodworker's vise comprising a first jaw, a second jaw moveable relative to the first jaw, a spindle secured to the second jaw, a cam-engaging surface, and a rapid-acting nut assembly including a nut disposed about the spindle and first and second cam surfaces, the spindle and rapid-acting nut assembly being operatively associated in a manner such that the spindle and nut are threadingly engaged when the first cam surface is engaged with the cam-engaging surface and are threadingly disengaged when the second cam surface is engaged with the cam-engaging surface to permit the spindle to slide relative to the nut, a guide rail for guiding the movement of the second jaw relative to the first jaw, the guide rail having an inverted U-shape and defining a channel along at least most of the length of the guide rail, the rapid-acting nut assembly and the spindle being received substantially within the channel and an inner surface of the guide rail defining the cam-engaging surface.

4. The vise of claim 3 wherein the guide rail is rigidly mounted to the second jaw and slidingly engaged with the first jaw.

5. A woodworker's vise comprising a first jaw, a second jaw moveable relative to the first jaw, a spindle secured to the second jaw, a cam-engaging surface, and a rapid-acting nut assembly including a nut disposed about the spindle and first and second cam surfaces, the spindle and rapid-acting nut assembly being operatively associated in a manner such that the spindle and nut are threadingly engaged when the first cam surface is engaged with the cam-engaging surface and are threadingly disengaged when the second cam surface is engaged with the cam-engaging surface to permit the spindle to slide relative to the nut, and a plate mounting the rapid-acting nut assembly to the first jaw, wherein the plate includes a pair of spaced walls to restrict movement of the rapid-acting nut assembly axially relative to the spindle, the rapid-acting nut assembly being disposed between the spaced walls.

6. The vise of claim 5 wherein each of the spaced walls defines an aperture that receives the spindle.

7. The vise of claim 5 wherein the plate is mounted to the first jaw by a plurality of fasteners.

8. A woodworker's vise comprising a fixed jaw adapted to be mounted to a bench and a moveable jaw assembly adjustably moveable in a first direction relative to the fixed jaw when the fixed jaw is mounted to the bench, the fixed jaw and moveable jaw assembly adapted to engage a work piece, the moveable jaw assembly including:

(a) an inner jaw adapted to contact the work piece;

(b) a front support;

(c) a pin mounting the inner jaw to the front support to permit the inner jaw to pivot relative to the front support and to permit the inner jaw to slide in a second direction relative to the moveable jaw assembly, the first and second directions being generally perpendicular to each other, and a spring engaging the pin and the inner jaw for positioning the inner jaw at the desired position along the second direction.

9. The vise of claim 8 wherein the spring is bent and elongated and is adapted to be received within a slot defined on the pin.

10. A woodworker's vise comprising a fixed jaw adapted to be mounted to a bench and a moveable jaw assembly adjustably moveable in a first direction relative to the fixed jaw when the fixed jaw is mounted to the bench, the fixed jaw and moveable jaw assembly adapted to engage a work piece, the moveable jaw assembly including:

(a) an inner jaw adapted to contact the work piece;

(b) a front support;

(c) a pin mounting the inner jaw to the front support to permit the inner jaw to pivot relative to the front support and to permit the inner jaw to slide in a second direction relative to the moveable jaw assembly, the first and second directions being generally perpendicular to each other, the inner jaw defining a channel receiving the pin, and including a cylindrical projection that defines the channel, the cylindrical projection adapted to slide relative to the pin.

11. The vise of claim 10 wherein the front support defines a bore for receiving the cylindrical projection.

12. A woodworker's vise comprising a fixed jaw adapted to be mounted to a bench and a moveable jaw assembly adjustably moveable in a first direction relative to the fixed jaw when the fixed jaw is mounted to the bench, the fixed jaw and moveable jaw assembly adapted to engage a work piece, the moveable jaw assembly including:

(a) an inner jaw adapted to contact the work piece;

(b) a front support;

(c) a pin mounting the inner jaw to the front support to permit the inner jaw to pivot relative to the front support and to permit the inner jaw to slide in a second direction relative to the moveable jaw assembly, the first and second directions being generally perpendicular to each other, the pin being mounted to the front support, the inner jaw including a cylindrical projection that defines a channel that slidably receives the pin.

13. The vise of claim 12 wherein the front support defines a pair of apertures disposed about the cylindrical projection for mounting the pin.

14. A woodworker's vise comprising a fixed jaw adapted to be mounted to a bench and a moveable jaw assembly adjustably moveable in a first direction relative to the fixed jaw when the fixed jaw is mounted to the bench, the fixed jaw and moveable jaw assembly adapted to engage a work piece, the moveable jaw assembly including:

(a) an inner jaw adapted to contact the work piece;

(b) a front support;

(c) a pin mounting the inner jaw to the front support to permit the inner jaw to pivot relative to the front support and to permit the inner jaw to slide in a second direction relative to the moveable jaw assembly, the first and second directions being generally perpendicular to each other, a spindle joined to the fixed jaw and the moveable jaw assembly and an inverted U-shaped guide rail defining a channel for receiving the spindle.

15. The vise of claim 14 wherein the guide rail is rigidly mounted to the front support and slidably mounted to the fixed jaw.

16. The vise of claim 15 wherein the guide rail includes a distal end having a flange and wherein the guide rail is mounted to the front support by at least one fastener extending through the flange.

17. The vise of claim 14 further including a rapid-acting nut assembly being received within the channel of the guide rail and being operatively associated with the spindle.

18. The vise of claim 14 wherein the guide rail defines a cam-engaging surface and the rapid-acting nut assembly includes a nut disposed about the spindle and first and second cam surfaces, the spindle and nut being threadingly engaged when the first cam surface is engaged with the cam-engaging surface and being threadingly disengaged when the second cam surface is engaged with the cam-engaging surface to permit the spindle to slide relative to the nut.

19. The vise of claim 18 further including a biasing element adapted to urge the spindle into engagement with the nut when the first cam surface is engaged with the cam-engaging surface.

20. The vise of claim 19 wherein the biasing element includes a spring.

21. The vise of claim 18 wherein the nut includes a plurality of internal threads substantially along the length of the nut.

22. The vise of claim 21 wherein the internal threads that have an arcuate length in the range of about 150° to 180°.

23. A woodworker's vise comprising a fixed jaw adapted to be mounted to a bench and a movable jaw assembly adjustably moveable in a first direction relative to the fixed jaw when the fixed jaw is mounted to the bench, the fixed jaw and moveable jaw assembly adapted to engage a work piece, the moveable jaw assembly including:

(a) an inner jaw adapted to contact the work piece;

(b) a front support; and (c) a pin mounting the inner jaw to and against the front support for pivotal movement of said inner jaw relative to the front support and for slidable movement of the inner jaw relative to the front support in a second direction generally perpendicular to the first direction of movement of the moveable jaw assembly, the inner jaw including a pair of tapered surfaces angularly related to each other and in selective supporting contact the front support to provide a variable angular orientation of the inner jaw relative to the front support and to facilitate pivoting of the inner jaw relative to the front support.

* * * * *